US008282302B2

(12) United States Patent
Zahn et al.

(10) Patent No.: US 8,282,302 B2
(45) Date of Patent: Oct. 9, 2012

(54) PEN WITH LOCKING CAP

(75) Inventors: Werner Zahn, Geroldsgrün (DE); Jochen Griesheimer, Schwarzenbach (DE)

(73) Assignee: Faber-Castell AG, Stein (DE)

( * ) Notice: Subject to any disclaimer, the term of this patent is extended or adjusted under 35 U.S.C. 154(b) by 508 days.

(21) Appl. No.: 12/542,245

(22) Filed: Aug. 17, 2009

(65) Prior Publication Data

US 2010/0040404 A1 Feb. 18, 2010

(30) Foreign Application Priority Data

Aug. 15, 2008 (DE) ..... 10 2008 041 282

(51) Int. Cl.
*B43K 5/00* (2006.01)

(52) U.S. Cl. ..... 401/202; 401/196

(58) Field of Classification Search ..... 401/196, 401/198, 202, 269, 283
See application file for complete search history.

(56) References Cited

U.S. PATENT DOCUMENTS 2,547,803 A * 4/1951 Adams ..... 401/247
3,475,103 A * 10/1969 Danjczek ..... 401/194
4,231,669 A * 11/1980 Rosbiegalle et al. ..... 401/58
4,748,990 A * 6/1988 Brown et al. ..... 132/320
4,859,104 A * 8/1989 Roeder et al. ..... 401/202
5,259,682 A * 11/1993 Uchiyama ..... 401/185
5,904,433 A * 5/1999 Kay ..... 401/269
6,102,602 A * 8/2000 Kageyama et al. ..... 401/269
6,176,632 B1 * 1/2001 Kageyama et al. ..... 401/186
2009/0269122 A1 * 10/2009 Akiyama ..... 401/198

FOREIGN PATENT DOCUMENTS

DE 1 901 668 U1 10/1964
DE 206 548 B 2/1984
DE 88 14 492 U1 3/1989

* cited by examiner

*Primary Examiner* — David Walczak
*Assistant Examiner* — Jennifer C Chiang
(74) *Attorney, Agent, or Firm* — Laurence A. Greenberg; Werner H. Stemer; Ralph E. Locher

(57) ABSTRACT

A pen includes a shank that has a reservoir and an applicator tip for an application fluid that includes a solvent that is volatile at room temperature. The pen also includes a closure cap that is fitted onto the shank. The closure cap has a cavity that accommodates the applicator tip. The closure cap includes a storage chamber for accommodating a sacrificial liquid that is volatile at room temperature. The closure cap also has a connecting channel that communicates with the storage chamber and the cavity.

16 Claims, 8 Drawing Sheets

PEN WITH LOCKING CAP

BACKGROUND OF THE INVENTION

Field of the Invention

The invention relates to a pen having a closure cap.

Such pens comprise a reservoir for storing an application fluid and also an applicator tip for applying the fluid to a surface. The application fluid contains a solvent which is volatile at room temperature and, following application, evaporates and thus makes it possible for the application fluid to dry on or form a film. The pens comprise a closure cap which can be removed from the pen in order for the latter to be used and which has a cavity intended for accommodating the applicator tip.

Such pens are known today in a variety of different embodiments, e.g. in the form of writing implements such as fountain pens, touch-up pens or multimarker pens for applying ink or paint, but also, recently, in the form of implements used for cosmetics purposes, such as nail-polish or mascara applicators for applying, for example, a paste. The applicator is, for example, a brush, a sponge or a fiber or sintered tip. Examples of conceivable solvents are water, but also solvents such as ethyl acetate, butyl acetate, propyl acetate, ethanol, isopropanol, butyl alcohol or diacetone alcohol, for example for nail polishes.

Solvents are divided up in accordance with volatility or evaporation number, which describes the tendency of a solvent to evaporate. High-volatility solvents are those with an evaporation number of less than 10, medium-volatility solvents are those with an evaporation number of 10 to less than 35 and low-volatility solvents are those with an evaporation number of 35 or more. The present patent application deals with solvents with evaporation numbers of less than 35, in particular of less than 10.

The problem with the pens described is that, despite a closure cap being fitted, drying out of the applicator tip can be observed. This is due, on the one hand, to the fact that it is not possible, with reasonable outlay, for the closure cap to be fitted in a fully gas-tight manner on the pen. On the other hand, in particular in the case of closure caps produced from plastic, it is also possible for solvents to diffuse through the material of the closure cap.

DE 19 01 668 U discloses a drawing pen which has a water-filled storage element in the cap region for safeguarding against drying out.

It is known from DD 206 548 for the storage element, when the cap has been pulled off, to be closed by a valve which is actuated by the drawing tip.

BRIEF SUMMARY OF THE INVENTION

It is an object of the present invention to improve a pen of the type mentioned above.

The invention is based on the general concept of the closure cap of a pen of the type mentioned in the introduction containing a storage chamber and a connecting channel, which connects the storage chamber fluidically to the cavity, the storage chamber serving to accommodate a sacrificial liquid which is volatile at room temperature. The sacrificial liquid here contains at least one solvent which evaporates from the liquid phase into the gaseous phase. The gaseous phase of the sacrificial liquid will be referred to hereinbelow, for short, as a sacrificial solvent.

The sacrificial liquid thus evaporates to form a sacrificial solvent and passes through the connecting channel into the cavity, where, with the closure cap fitted, the sacrificial solvent encloses the applicator tip and impregnates the cavity. In other words, instead of the solvent of the application fluid, the sacrificial liquid then evaporates to form a sacrificial solvent. This configuration of the closure cap prevents the applicator tip, or the application fluid thereon, from drying out.

The vapor pressures of the solvent of the application liquid and the vapor pressure of the sacrificial liquid are thus added to one another in the cavity. The gas phase or vapor phase in the cavity of the closure cap is thus made up both of the sacrificial liquid and from the solvent of the application liquid. Accordingly, leakage on account of a lack of sealing between the closure cap and pen shank takes place at the expense of the solvent of the application liquid and of the sacrificial liquid. As a result, the applicator tip itself cannot dry out, or drying out is delayed. In addition, thickening of the application liquid on account of loss of solvent is prevented or delayed.

The sacrificial liquid may be the solvent of the application fluid, or may contain the same. When the covering cap is in the plugged-on state, the application fluid is thus enclosed by its own solvent, although the latter comes, in part, from the storage chamber. Evaporation of solvent from the application fluid or drying out of the applicator tip is thus avoided in a particularly effective manner.

Generally the vapor pressure of the sacrificial liquid or of the sacrificial solvent should be comparable to, or higher than, the corresponding value of the application fluid or of the components thereof, that is to say the boiling point should be lower.

According to the invention, the closure cap contains a sealing element, which can be moved between a sealing position, in which it closes the connecting channel, and an opening position, in which it frees the connecting channel. The sealing element here, for movement between the opening position and sealing position, is coupled for movement to a portion of the pen shank which projects into the cavity of the closure cap. In other words, when the covering cap is being fitted or pulled off, this shank portion, as a result of the movement coupling, moves the sealing element and respectively frees the connecting channel or closes the same. Thus, when the closure cap is in the fitted state, the connecting channel is open, in which case—as has been described above—the sacrificial liquid can evaporate and pass to the applicator tip. When the closure cap has been removed, the cavity is in connection with the surroundings. In this case, however, there is no sacrificial solvent passing through the closed connecting channel to the cavity and, from there, into the surroundings. Unnecessary release of evaporating sacrificial liquid into the surroundings is thus prevented. This sacrificial liquid or the sacrificial solvent remains in the storage chamber, which is now closed off from the exterior surroundings. Since actuation takes place by way of the pen shank, the pen tip remains free of mechanical loading. This is important, for example, for fine fiber tips which must not be subjected to deformation.

In a preferred embodiment, the sealing element is mounted in an axially displaceable manner in the cap. The axial movement is a basic movement which generally takes place when the pen cap is being fitted or pulled off. If the sealing element is likewise mounted in an axially displaceable manner in the closure cap, the plug-on or pulling-off movement or relative movement between the pen shank and closure cap can easily be converted, by straightforward movement coupling, into the axial movement of the sealing element in the closure cap.

In a further preferred embodiment of the invention, the sealing element comprises a wall segment which delimits the storage chamber from the cavity. The wall segment here leaves free merely at least one longitudinal portion of the connecting channel in order for it to be possible for this to extend through the wall segment or to extend past the same. The sealing element also comprises a driver element, which interacts with the shank portion and is directed toward the cap opening in order to come into engagement there with the shank portion. In other words, that is to say that, during the operation of plugging on or pulling off the closure cap, the driver element is moved by the shank portion, which, in turn, actuates the closure mechanism of the sealing element, e.g. in the form of a movement of the wall segment. The wall segment, as part of the sealing element, may likewise be mounted in an axially displaceable manner in the closure cap.

In a further preferred embodiment, a gap is present between the inside of the closure cap and the wall segment, and this gap forms at least one longitudinal portion of the connecting channel. The gap here may be, in particular, an annular gap encircling the wall segment. The annular gap may then be of such a small width that, for example, liquid sacrificial medium is retained in the storage chamber by the annular gap and only vaporous medium, that is to say evaporated sacrificial liquid or sacrificial solvent, can pass through the annular gap to the cavity. The annular gap then forms a diffusion section.

In particular here it is possible for the flow cross section of the gap to be smaller than that of the rest of the connecting channel. The gap then essentially determines the flow behavior of the connecting channel. It is thus possible to ensure, for example by dimensioning of the gap, that the correct quantity of sacrificial solvent passes into the cavity precisely quickly enough in order to protect the applicator tip from drying out.

In a preferred embodiment, the gap may be an annular gap. This is easy to achieve in particular for rotationally symmetrical pens.

In a further preferred embodiment, in the event of a corresponding gap being present, a closure element is arranged on the inside of the closure cap and closes the gap in the closing position of the sealing element. In other words, when it moves, the sealing element moves with sealing action against the closure element.

In a particularly preferred embodiment, this closure element may be an encircling annular protrusion. Such an annular protrusion interacts for example particularly straightforwardly with an annular gap encircling the wall segment in that the wall segment slides in the manner of a piston, leaving free the annular gap in the cylindrical covering cap in the process, until it meets the annular protrusion, which then closes the annular gap.

A particularly compact configuration of the pen is achieved if the sealing element is at least part of an inner cap arranged within the closure cap. A corresponding inner cap may be produced particularly straightforwardly and cost-effectively for example by injection molding, is stable and forms the cavity on its inside and can be straightforwardly mounted in particular in an axially displaceable manner in the closure cap. The connecting channel, or at least part thereof, may then be formed particularly straightforwardly as a through-passage in the inner cap.

According to a development of the abovementioned embodiment with wall segment and driver element, the inner cap may then comprise these two components. It is possible here for the inner-cap base, which is directed away from the cap opening, to constitute the wall segment. In this region, the annular gap may then be formed between the inner cap and closure cap. The inner-cap wall which extends away from the base can then form the driver element, or contain the same.

In a further preferred embodiment of the invention, the pen comprises a first axially effective form fit, which restricts the relative movement between the sealing element and closure cap when the latter is removed from the shank. A second form fit, which brings about the movement coupling between the sealing element and shank portion when the closure cap is pulled off, is formed between these two elements. The first form fit here, as seen in the axial direction, has a higher level of strength than the second.

A corresponding configuration of the pen makes it possible to realize the following movement sequence when the pen cap is being removed: a user grips the closure cap and begins to unscrew, or pull off, the same from the pen. The sealing element here is still held firmly on the shank via the second form fit, as a result of which the pulling-off movement of the closure cap results, in the first instance, in a relative movement between the closure cap and sealing element. It is only when the closure cap has been pulled off the pen and/or sealing element to the extent that the first form fit engages that any further relative movement between the closure cap and sealing element is prevented. When the closure cap is subjected to further force during the pulling-off movement, however, in the first instance the second form fit is disengaged, i.e. the sealing element releases its movement coupling to the shank. In other words, the entire closure cap is released from the shank.

The corresponding relative movement between the closure cap and sealing element in this case results first of all in the connecting channel being closed, in which case the latter is already closed when the sealing element is detached from the shank. When the closure cap is plugged onto the pen, in the first instance the sealing element is pushed back again into the closure cap and, finally, the sealing element latches on the shank.

In a preferred embodiment, the two form fits are respectively formed in each case by radially overlapping protrusions on the closure element and sealing element, on the one hand, and on the sealing element and shank portion, on the other hand.

It is conceivable to use, for example for the first form fit, a stop element, which bounds the relative movement between the sealing element and closure cap when the closure cap is being removed from the pen, and, for the second form fit, a latching element, which retains the sealing element in the first instance on the shank when the closure cap is being removed. The latching force of the latching element here is smaller than the stopping force of the stop element, for which reason, when the closure cap is being pulled off, only the second form fit releases when the first is subjected to stopping action.

The first form fit may be formed, in particular, by a stop arranged on the closure cap and by a protrusion arranged on the sealing element. The second form fit may be formed by a latching nose on the shank portion and a latching protrusion on the sealing element. Such a solution is easy to realize, for example, by injection molding.

In a further preferred embodiment, the closure cap has a covering which is coupled for movement to the sealing element and, when the closure cap is in the released state, conceals a portion of the closure cap which adjoins the opening. The closure cap, in this portion, usually has a retaining element, e.g. a screw thread, a bayonet closure or a frictional or snap-fit connection, which arrests the closure cap on the shank. The covering then conceals this retaining element when the closure cap is in the released state. In other words, when the closure cap is being pulled off the pen, as explained above, the sealing element moves, and this sealing element in turn, via movement coupling, guides the covering into a position in which it conceals the retaining element. When the closure cap is later fitted onto the pen, the retaining element is thus concealed in a first instance, for which reason the retaining element, that is to say for example the thread, cannot be soiled by application fluid. As a result of the plug-on movement and the corresponding movement coupling to the sealing element, the covering is moved away from the retaining element as the closure cap is being plugged on, in which case the retaining element, finally, can grip on the pen in order to arrest the closure cap thereon.

In a further preferred embodiment of the invention, the storage chamber contains a storage element for the sacrificial liquid. This storage element may be, for example, a fiber element or sintered element. Within the storage chamber, the sacrificial liquid is then stored in the storage element.

However, it is also conceivable for the storage chamber to be closed by a semipermeable membrane, in order thus to create a retaining volume for the sacrificial liquid. The membrane could also fill, for example, the abovementioned diffusion gap or channel, or form the same. The membrane may then also serve for metering the quantity of solvent dispensed per unit of time, or be configured accordingly.

In a preferred embodiment, the storage element may be a cartridge, that is to say a receptacle filled with sacrificial liquid. Rather than the entire closure cap, it is therefore only the cartridge which need be suitable for storing the sacrificial liquid, e.g. configured in an appropriately material-compatible manner. This also gives rise to the advantage that the cartridge can be filled prior to completion of the pen as a whole and, in the filled state, can be inserted into the closure cap or the storage chamber during assembly. The cartridge here is, for example, a liquid cartridge with wick.

The organic solvents which are possible as the sacrificial liquid here have a high vapor pressure, often pose a health hazard and, in particular, are highly flammable. Appropriate precautions, in particular fire protection measures or explosion protection measures, have to be put in place for handling such substances. The advantage with using a cartridge is that the cartridge can be filled in a separate method step. It is only during production of the cartridge, and only in that area, that the precautions then also have to be taken, this being easier to manage than providing precautionary measures throughout the production of the pen. For the actual assembly of the pen, there is then no longer any need for precautions because the cartridge can be supplied in the closed state to the assembly line. The operation of assembling the pen can then be carried out easily and straightforwardly. The cartridge has to be closed such that the sacrificial solvent can pass in a controlled manner into the closure cap. Conceivable here for example is a membrane or a sintered disk.

The cartridge should thus be closed when it is supplied to the assembly line. Either the wall thickness of the cartridge, at least at one location, is selected to be thin enough to allow it to be pierced, with a small opening then being formed, when it is fitted in the pen. Sacrificial liquid then can escape through this opening not in the free-flowing state, but probably in the form of liquid vapor. As an alternative, it is conceivable for the cartridge wall to contain an opening which is closed, for example by a plastic film or the like, following filling. The closure element can likewise be pierced, or pulled off, at a later stage. A further option is for the opening of the cartridge to be closed by a material which is permeable for the liquid vapor. Such an opening, of course, likewise has to be closed, for example using an adhesively attached film or in some other way.

A further advantage of a cartridge is that a relatively large quantity of sacrificial liquid can be accommodated in the closure cap. This is because the cartridge—for example in contrast to a storage element being used—need not contain any storage material with capillary action, since the sacrificial liquid is already retained by the cartridge.

The cartridge can be introduced into the closure cap, or the storage chamber thereof, through the customary single opening of the closure cap, which also serves to fit the latter onto the pen. It is also conceivable however, in an alternative embodiment, for the closure cap, in the region of the storage chamber, to have a through-passage in which the cartridge is accommodated with sealing action. In other words, the cartridge thus forms part of the closure cap or continues the latter in the region of the through-passage. During assembly of the pen, the cartridge can then easily be inserted into the closure cap from the inside or outside. It is also, for example, possible to provide a viewing window in the cartridge itself, this viewing window then being visible as part of the closure cap and allowing the quantity of sacrificial liquid which is still present to be checked.

In an alternative embodiment, at least part of the cartridge is integral with the abovementioned inner cap. This is easily possible, for example, by injection molding; there is then no need for a separate component to be produced for the cartridge.

In an alternative embodiment, at least part of the connecting channel is designed in the form of a capillary channel. It is then not absolutely necessary for the channel to be closed by a sealing element. A seal between the inner and outer caps may then be, for example, fixed, that is to say non-displaceable. The inner cap also has to be mounted, for example, in a non-displaceable manner in the closure cap. Capillary channels which open out into the storage chamber are then located between the inner and closure caps and between a seal, accommodated therebetween, and the cap. The capillary channels, at the same time, open out into the cavity, in which case sacrificial solvent can evaporate out of the storage chamber, through the channels, into the cavity.

The capillary channels here can also narrow in the direction of the storage chamber. It is not then possible, on account of the directed capillary force, for sacrificial liquid to run out of the storage chamber.

The capillary channels may be formed by grooves or flattenings on the outside of the seal or the inside of the closure cap or the outside of the inner cap.

For further description of the invention, reference is made to the exemplary embodiments in the drawings, in which, schematically in each case:

DESCRIPTION OF THE INVENTION

Figure 1:
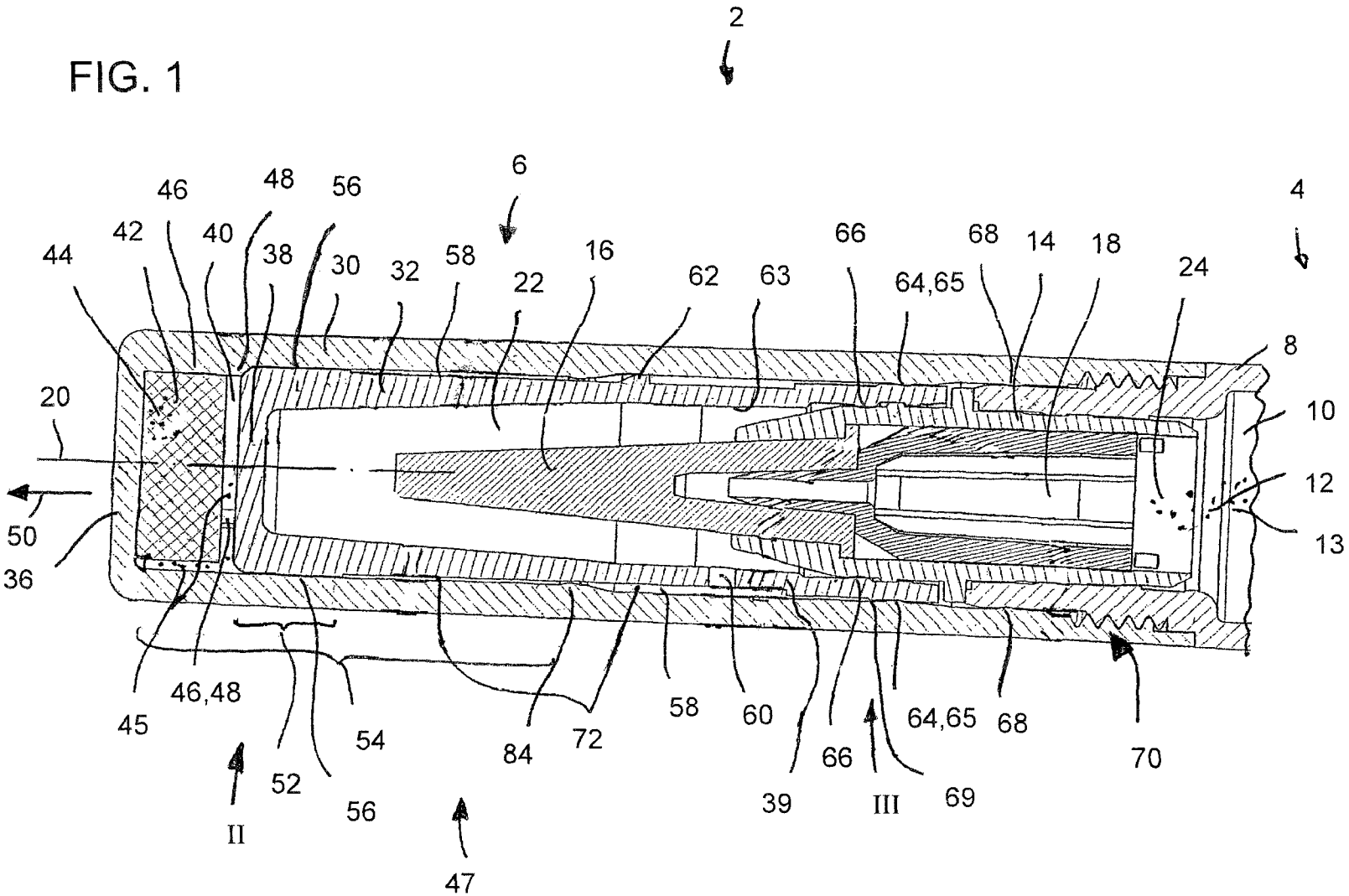
FIG. 1 shows a pen with fitted closure cap.

FIG. 1 shows a pen 2 having a shank 4, of which only the front part is shown. A cap 6 has been fitted onto the shank 4 by way of its opening 24 since the pen is not currently being used, that is to say is located in a closure or storage position. The shank 4 here closes the opening 24. The shank 4 essentially comprises a container 8 which forms the basic body, or grip body, of the pen 2 and has a reservoir 10 for an application fluid 12 with a solvent 13. The shank also comprises a shank portion 14 which is fitted onto the container 8 on the end side, acts as an adapter and carries an applicator tip 16. The applicator tip 16 is connected to the reservoir 10 via a transporting channel 18 and serves for applying the application fluid 12 when the pen 2 is in use. The pen is constructed in an essentially rotationally symmetrical manner about a center longitudinal axis 20.

The cap 6, in the exemplary embodiment, is configured as an outer cap 30 and contains an inner cap 32 accommodated therein. In the axial direction of the center longitudinal axis 20 of the pen 2, the inner cap 32 is approximately a third shorter than the outer cap 30. In FIG. 1, the inner cap 32 is located in the position in which it has been advanced all the way to the front end 34 of the outer cap 30. Remaining between the base 36 of the outer cap and the base 38 of the inner cap, then, is a storage chamber 40, in which a storage element 42 is accommodated. The storage element 42 is impregnated with a sacrificial liquid 44 from which evaporates, at room temperature, a sacrificial solvent 45, which is distributed in the storage chamber 40. The inner cap 32 is formed essentially by a wall portion in the form of a base 38 and by a sleeve-like wall which adjoins the wall portion and, in turn, constitutes a driver element 39 for the base 38.

The storage element 42 is retained in the interior of the outer cap 30, i.e. in the storage chamber 40, by three—or, in an alternative embodiment, a plurality of—clamping webs 46 distributed over the circumference of the cap 6, only two of these clamping webs being visible in FIG. 1. Those ends 48 of the clamping webs 46 which are oriented in the direction of the opening 24 form, at the same time, a stop for the inner cap 32 in the direction of the arrow 50 in that relative position between the inner cap 32 and outer cap 30 which is shown in FIG. 1.

The cap 32, in a head region which acts as a sealing element 52, has the external diameter $d_a$ of its outside 53 dimensioned somewhat smaller than the internal diameter $d_i$ of the outer cap 30 on its inside 51. Along a longitudinal portion 54, an annular gap 56 thus remains free between the outer cap 30 and inner cap 32. The annular gap 56, a gap 58 which adjoins the same, and a bore 60—or, in an alternative embodiment, a plurality of bores 60—in the inner cap 32 form a channel 72 which connects the storage chamber 40 to the cavity 22.

Figure 2:
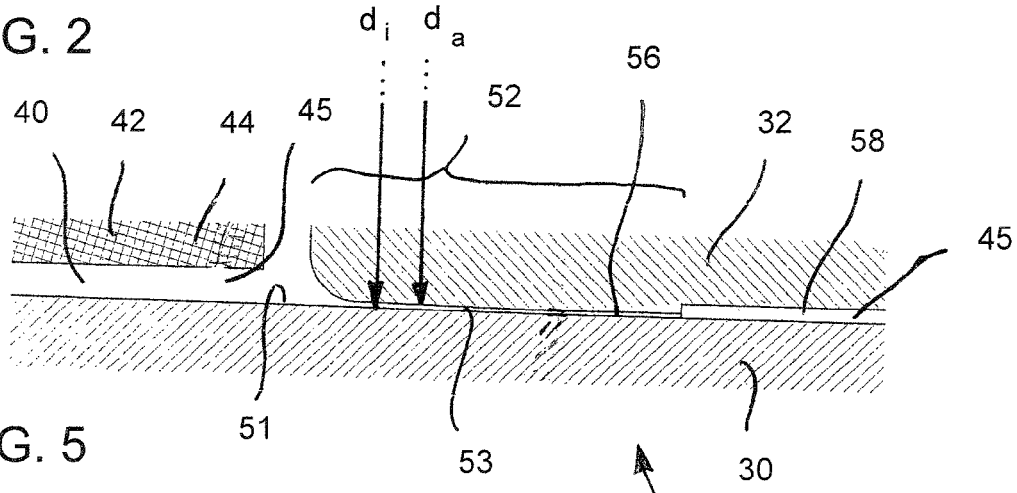
FIG. 2 shows the detail II from FIG. 1.

FIG. 2 illustrates the corresponding conditions on an enlarged scale. In the open position 47 of the channel 72 shown, sacrificial solvent 45 passes out of the storage chamber 40 through the annular gap 56. In contrast, sacrificial liquid 44 is held back on account of the small dimensioning of the inside width of the annular gap 56. Sacrificial solvent 45 thus encloses the applicator tip 16 in the cavity 22 in order to safeguard this applicator tip against drying out.

In order to maintain the annular gap 56, or in order to mount the inner cap 32 concentrically in the outer cap 30, the latter is centered via three—or, in an alternative embodiment, a plurality of—noses 62 distributed over its circumference and via an annular seal 64 fitted on the inside 51 of the outer cap 30. The individual noses 62, moreover, leave space between them for forming the channel 72. The annular seal 64 here also bounds the gap 58, in the open position 47 shown, in the direction of the opening 24. The cavity 22, in turn, is sealed by an annular seal 66 which is fitted on the inside 63 of the inner cap 32 and acts on the shank portion 14. In addition, the outer cap 30 is also sealed in relation to the shank 4 or container 8 by a further annular seal 68. In order for the cap 6 to be fastened securely on the shank 4, the two components are provided with a portion 70 which, in the exemplary embodiment, is configured as a screw thread.

Figure 3:
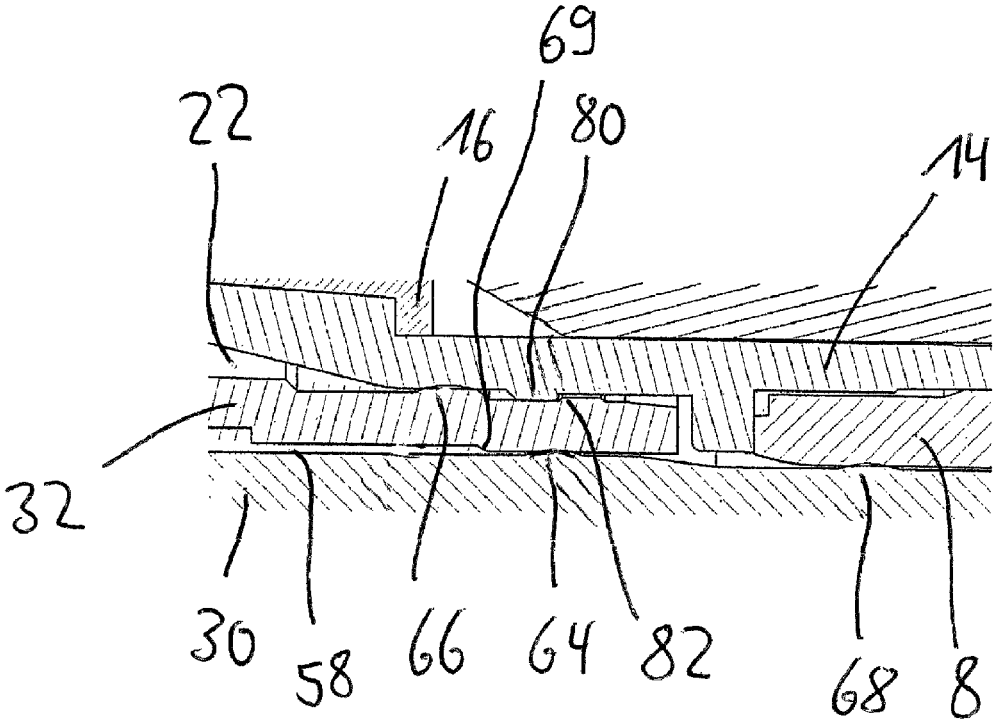
FIG. 3 shows the detail III from FIG. 1.

In order for the pen 2 to be used, the cap 6 is released in the first instance by being unscrewed from the portion 70. As a result, the annular seal 64 negotiates an inwardly projecting shoulder 69 of the inner cap 32, for which reason the frictional resistance between the outer cap 30 and inner cap 32 decreases abruptly. The outer cap 30 is then pulled off further in the direction of the arrow 50. In the first instance here, a relative movement takes place between the outer cap 30 and inner cap 32, since the inner cap 32 is retained in the first instance on the shank portion 14, that is to say remains initially in an unchanged position in relation to the shank 4. This is brought about by latching noses 80 which are arranged on the outside of the shank portion 14 and engage behind a correspondingly latching protrusion 82 on the inner cap 32. FIG. 3 shows the corresponding detail III in this respect.

Figure 5:
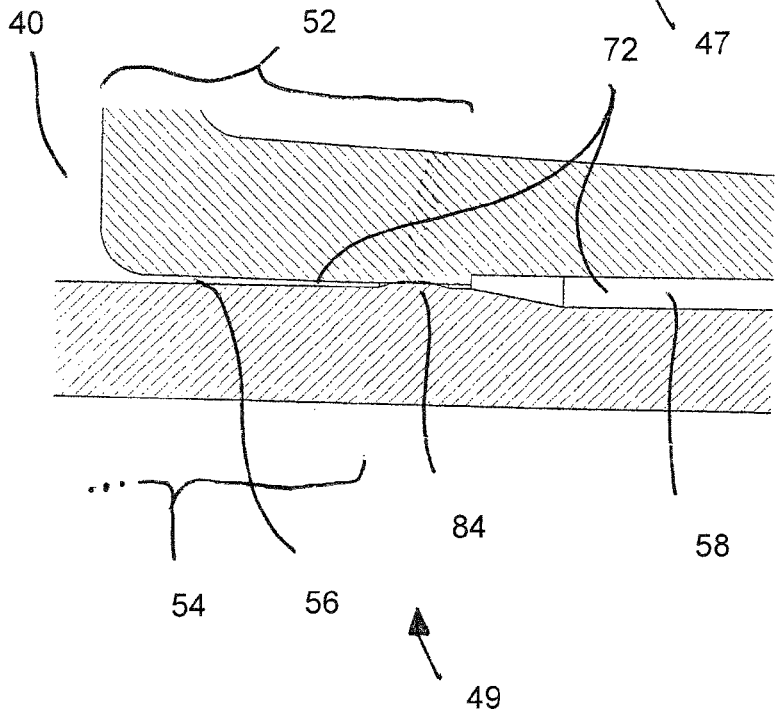
FIG. 5 shows the detail V from FIG. 4.
Figure 4:
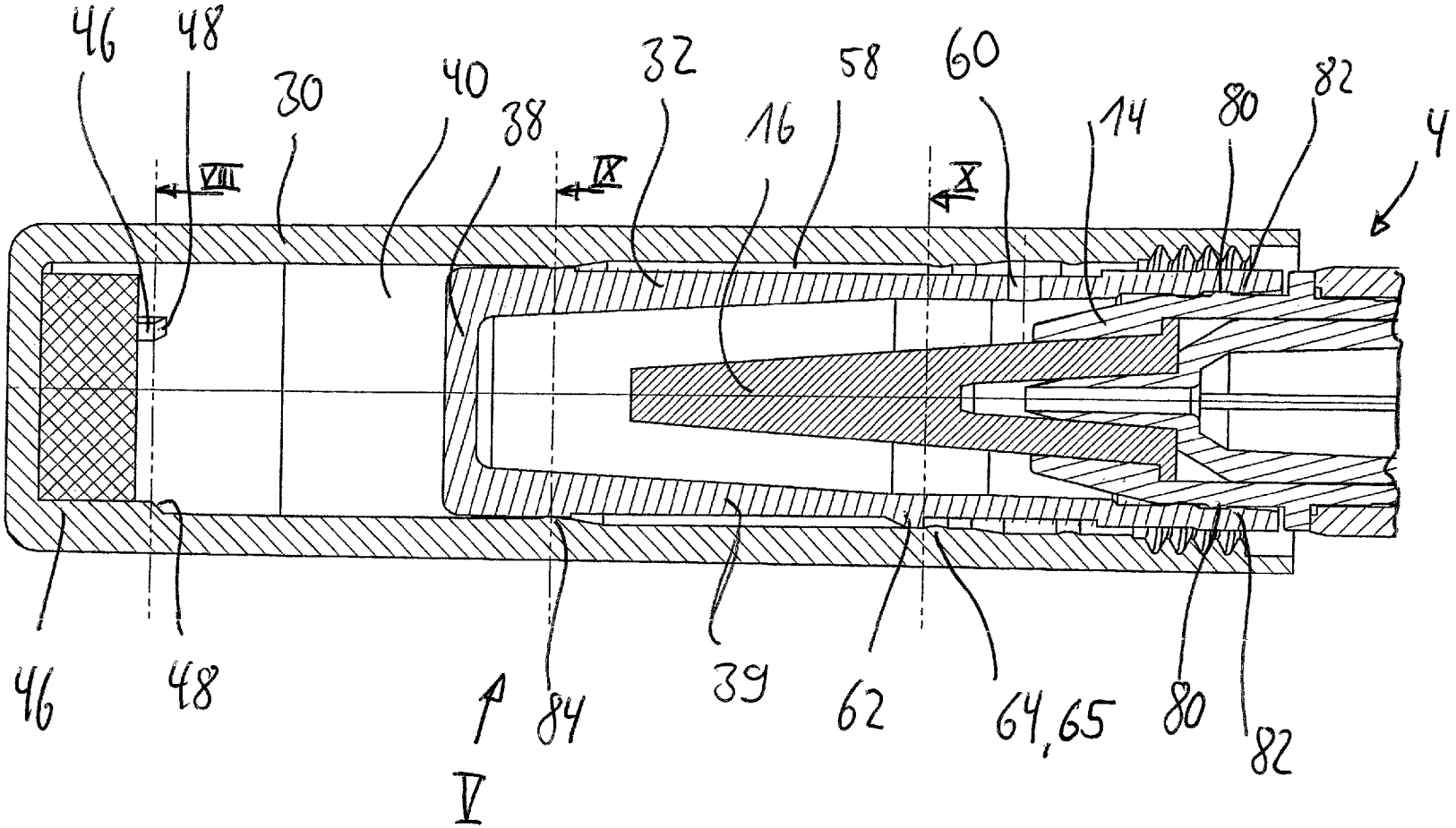
FIG. 4 shows the pen from FIG. 1 as the closure cap is being pulled off.

The outer cap 30 thus continues to move away from the inner cap 32 in the direction of the arrow 50 until the sealing element 52 leaves the longitudinal portion 54 and runs with sealing action onto a closure element 84 which is arranged on the inside 51 of the outer cap 30 and, in the exemplary embodiment, is configured as an annular seal. The corresponding situation is illustrated in FIG. 4 and, in detail form, in FIG. 5. By virtue of the closure element 84, the annular gap 56, and thus the entire channel 72, is closed and/or the storage chamber 40 is hermetically sealed. Solvent 44 cannot evaporate needlessly via the gap 58, which is no longer sealed in relation to the surroundings. In the situation which is shown in FIGS. 4 and 5, the relative movement between the outer cap 30 and inner cap 32 terminates since the nose 62 strikes against the annular seal 64. In addition to performing its sealing function, the annular seal 64 thus fulfills a double purpose as a stop 65. Further pulling on the outer cap 30 in the direction of the arrow 50 causes the latching force of the latching noses 80 from the latching protrusions 82 to be overcome and thus results in them disengaging and thus in the cap 6 as a whole being released from the shank 4 or shank portion 14. Although the force to which the outer cap 30 is exerted overcomes the latching force here, it does not overcome the higher force with which the noses 62 strike against the stop 65. FIGS. 4 and 5 thus show the channel 72 and the cap 6 as a whole in the sealing position 49 which has now been reached.

Figure 6:
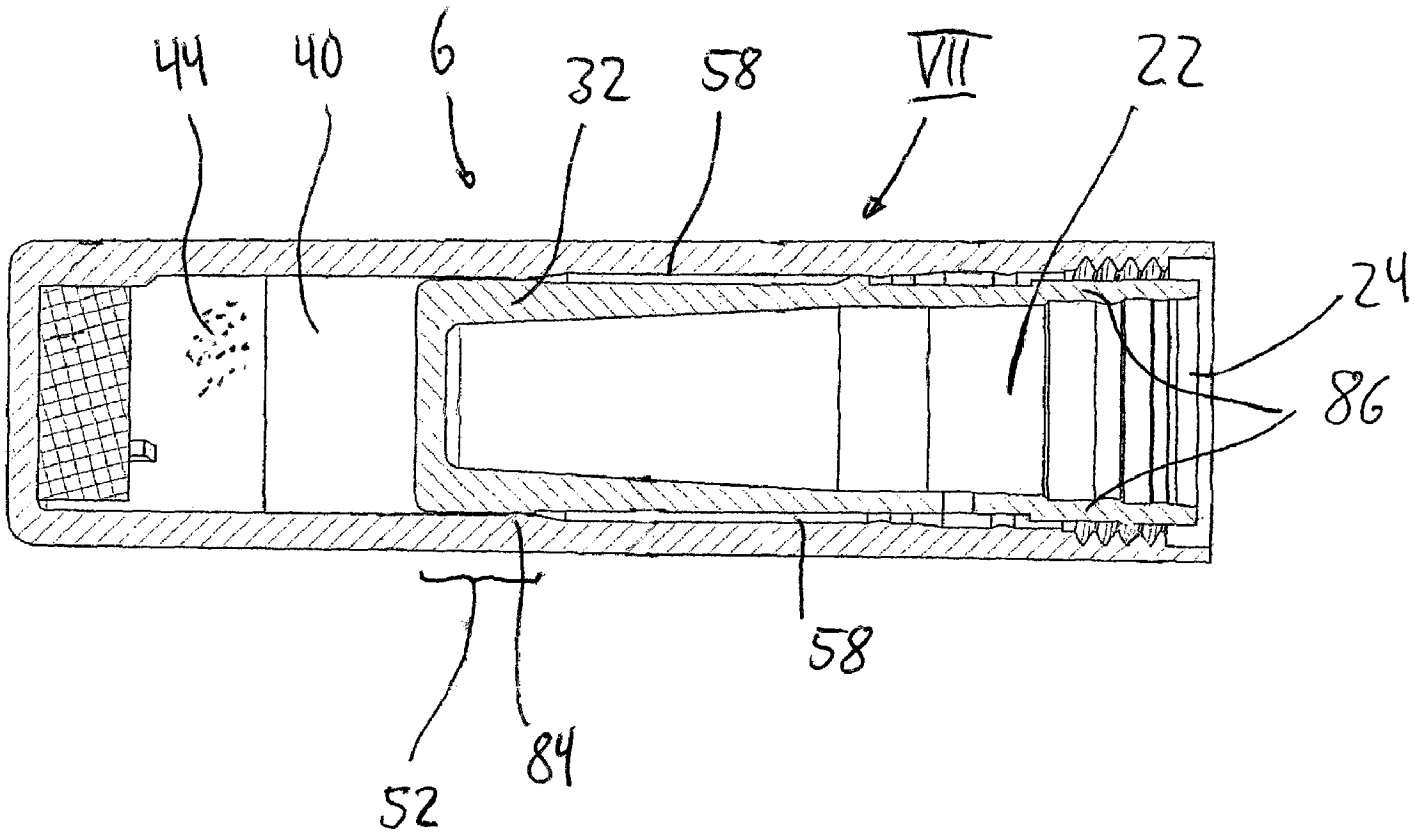
FIG. 6 shows the closure cap from FIG. 1 pulled all the way off the pen.

FIG. 6 shows the cap 6 in its fully released state. FIG. 6 also clearly shows that the storage chamber 40 is closed off with sealing action by the annular seal 84, in conjunction with the sealing element 52 of the inner cap 32, in relation to the gap 58, or the cavity 22 communicating with the surroundings, in order to prevent the sacrificial liquid 44 from evaporating unnecessarily. At the opening 24, the end portion of the inner sleeve 32 forms a skirt 86. Upon release of the cap 6, by the relative movement between the outer sleeve 30 and inner sleeve 32, this skirt is pushed over the inside of the portion 70 of the outer sleeve 30. The screw thread is thus safeguarded, for example, against contact with the applicator tip 16 and thus against soiling, e.g. by the application fluid 12.

Figure 7:
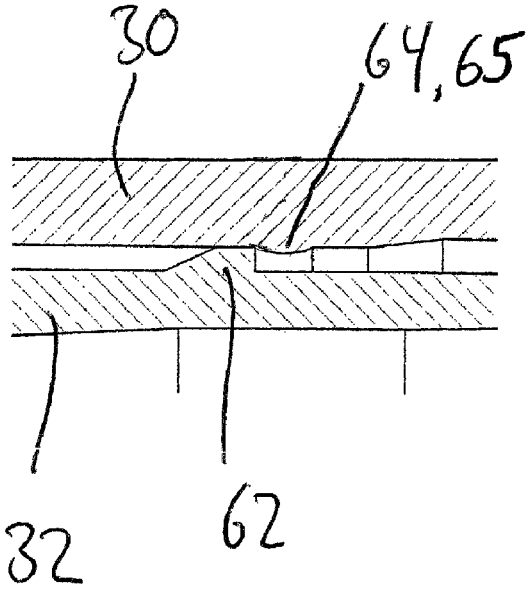
FIG. 7 shows the detail VII from FIG. 6, FIGS. 8-10 show sections through VIII, IX and X in FIG. 4.

FIG. 7 shows once again, in the detail VII, the nose 62 striking against the annular seal 64.

Figure 8:
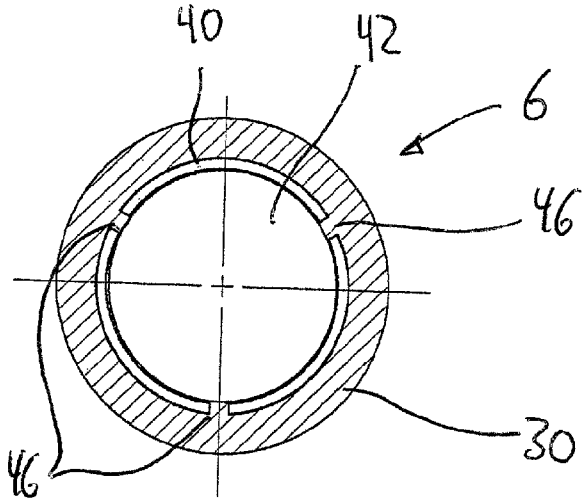

FIG. 8 shows a cross section through the cap 6 and, in particular, the storage element 42 accommodated concentrically in the clamping webs 46 of the outer cap 30.

Figure 9:
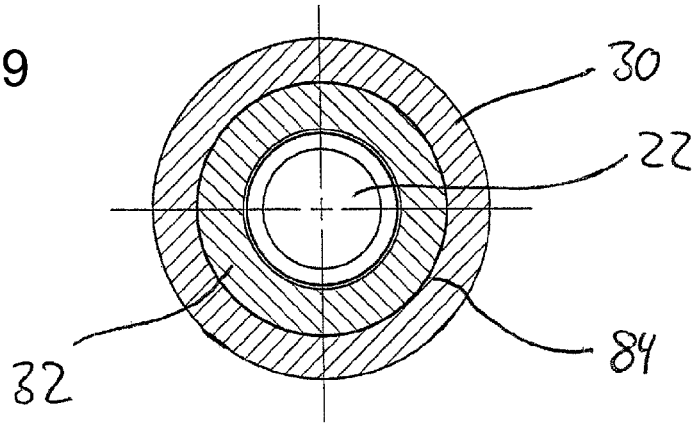

FIG. 9 shows the outer cap 30 accommodated with sealing action in the closure element 84 when the inner cap 32 is pulled out of the outer cap 30 counter to the direction of the arrow 50.

Figure 10:
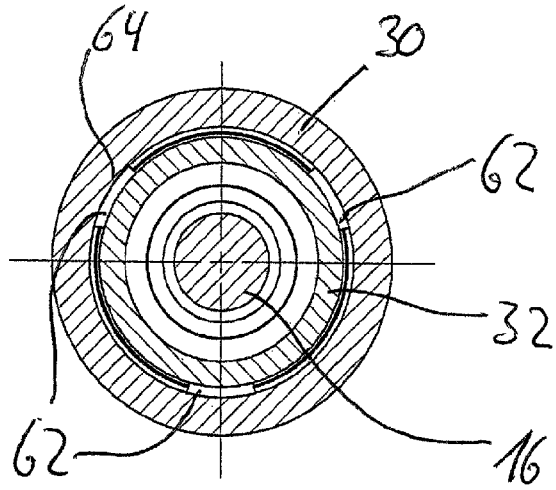

FIG. 10 shows the noses 62 which are distributed over the circumference of the inner cap 32 and serve for engaging behind the annular seal 64.

When the cap 6 is being fitted on the shank 4, in the first instance the shank portion 14 comes into contact with the inner cap 32 and subjects the latter to a force in the direction of the arrow 50, for which reason a relative movement takes place in this direction between the inner cap 32 and outer cap 30. The sealing element 52 slides off from the closure element 84 and frees the annular gap 56 and/or the channel 72. The relative movement is continued until engagement of the thread, now freed again from the skirt 86, in the portion 70. By virtue of the cap 6 being screwed onto the shank 4, finally, the inner cap 32 slides into the outer cap 30 again until its base 38 reaches the ends 48 of the clamping webs 46 and strikes against the same. Finally, the latching noses 80 then latch behind the latching protrusions 82, and at the same time the cap 6, with the aid of the screw thread, reaches its definitive position with sealing action, and engagement of all the seals 64, 66 and 68, on the shank 4.

Since the driver element 39 of the inner sleeve 32 carries both the latching noses 62, which are used for the pulling-off operation, and the latching protrusions 82, it causes the base 38 to move.

Figure 11:
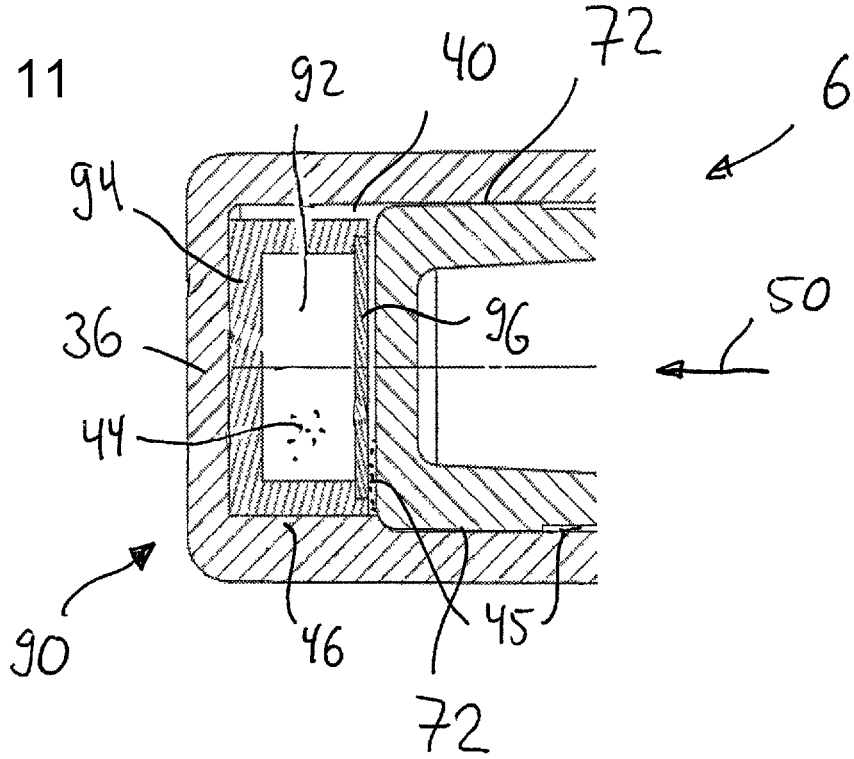
FIG. 11 shows a pen with a cartridge as storage element.

FIG. 11 shows part of an alternative cap 6. Instead of the storage element 42, with the aid of the clamping webs 46, a cartridge 90 has been clamped in the storage chamber 40 at the base 36. The cartridge 90 has a diffusion-sealed wall 94 which encloses a reservoir 92 for sacrificial liquid 44. On the side which is directed away from the base 36, the reservoir 92 is closed by a membrane 96—or, as an alternative, by a sintered disk. This allows sacrificial solvent 45 to pass through, but holds the sacrificial liquid 44 back. The membrane or sintered disk is welded with sealing action, for example, to the wall 94. During assembly of the pen 2, the cartridge is introduced into the cap 6 in the direction of the arrow 50.

In an alternative embodiment of a cap 6, the latter does not contain any cartridge 90. The storage chamber 40 is then filled solely with sacrificial liquid 44. In this embodiment, the inner cap 32 is arranged in a fixed state, that is to say in a non-displaceable manner, in the outer cap 30. This is achieved for example by a suitable clamping device (not illustrated), between the two sub-caps. The channel 72 then subjects the sacrificial liquid 44 to a capillary force and tapers in the direction of the arrow 50. This prevents sacrificial liquid 44 from passing out of the storage chamber 40, but ensures that it evaporates.

Figure 12:
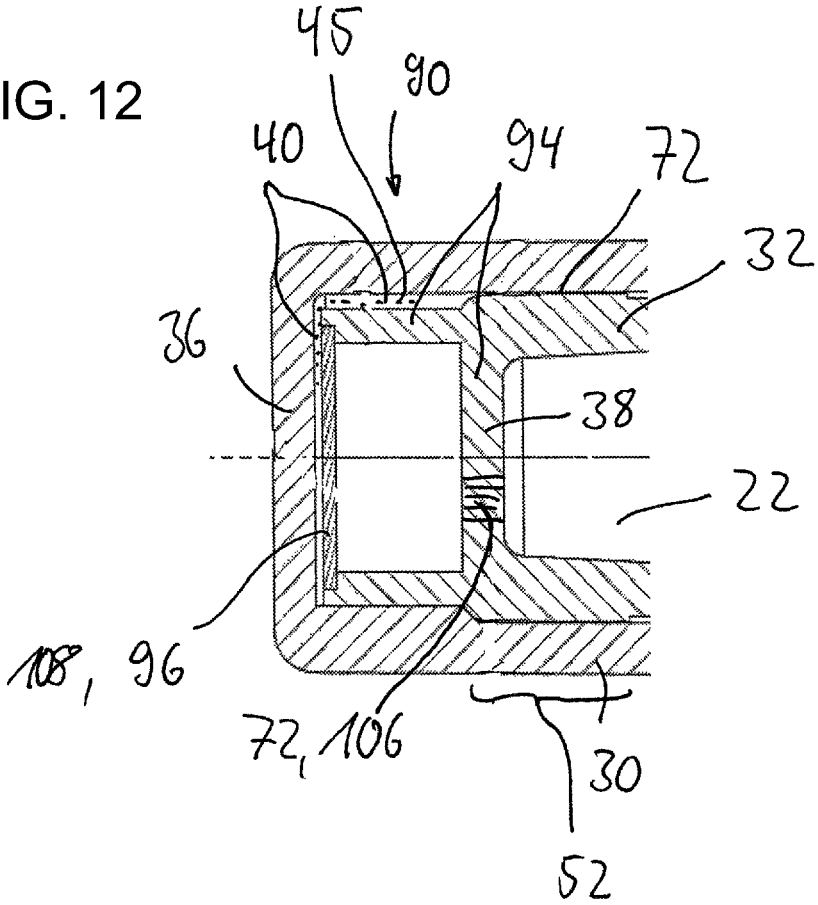
FIG. 12 shows a cartridge integrally formed on the inner cap.

FIG. 12 shows an alternative embodiment of a cartridge 90 in which the wall 94 is integral with the inner cap 32 or the base 38 thereof. The membrane 96 in this case, in contrast to FIG. 11, is directed toward the base 36. Since, as in FIG. 11, it is also the case in FIG. 12 that the cartridge 90 does not completely fill the storage chamber 40, it is once again possible for sacrificial solvent 45 to pass in a known manner through the channel 72 into the cavity 22.

It is also conceivable in accordance with FIG. 12 to have an alternative embodiment of the cap 6 in which the inner cap 32 is mounted in a fixed state, that is to say in a non-displaceable manner, in the outer cap 30. In this case however—in contrast to the corresponding embodiment according to FIG. 11—the two sub-caps are sealed in relation to one another in the region of the sealing element 52. It is thus not possible for any sacrificial solvent 45 or any sacrificial liquid 44 to pass through there. There is no longer any channel 72 present there. Instead of this, the base 38 has incorporated into it a capillary channel 106 which forms the channel 72 for the diffusion of sacrificial solvent 45 and/or sacrificial liquid 44. The latter then passes through the channel 106 into the cavity 22 directly from the storage chamber 40. In this embodiment, the membrane 96, which is no longer required, has been replaced by a sealing wall portion 108.

Figure 13:
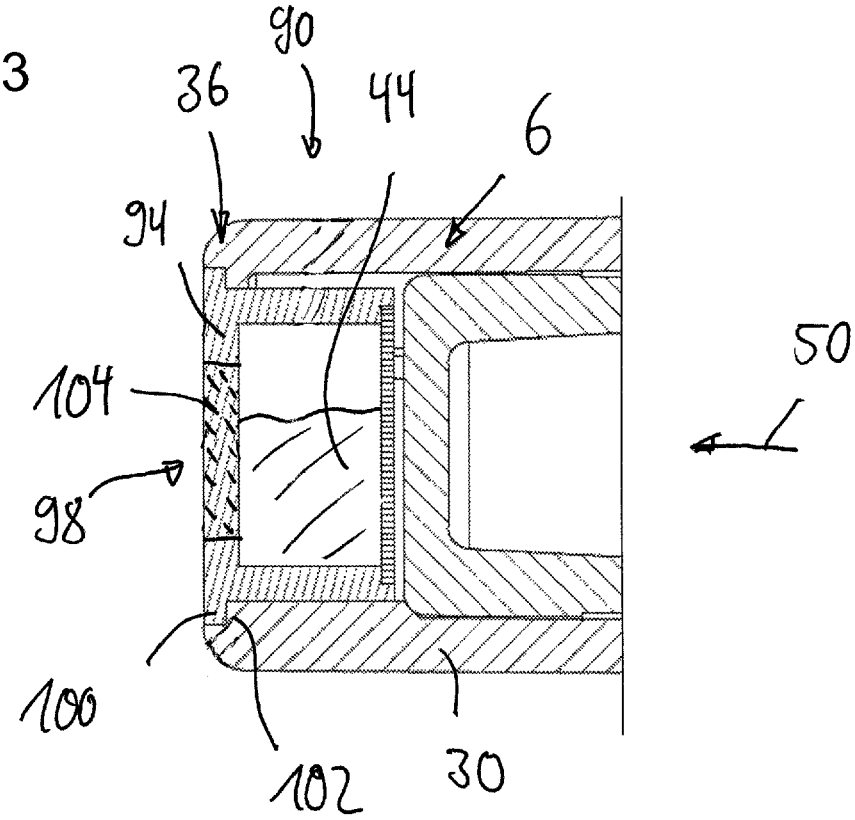
FIG. 13 shows a closure cap with a through-passage and a cartridge inserted from the outside.

FIG. 13 shows a further alternative embodiment of a cartridge 90. In this case, the base 38 of the cap 6 is provided with a through-passage 98, although this has been closed again by the cartridge 90. The cartridge 90 here, during assembly of the pen 2, is pressed into the outer cap 30 counter to the direction of the arrow 50 until it strikes with sealing action against a stop 102 by way of a protrusion 100.

In an alternative embodiment, the wall 94 contains a through-passage in the region of the base 38 and a see-through window 104 is inserted here. This allows a visual check to be made in respect of the filling level of sacrificial liquid 44 in the cartridge 90. It is also conceivable for the entire receptacle, that is to say in particular the entire wall 94, to be transparent.

Figure 14:
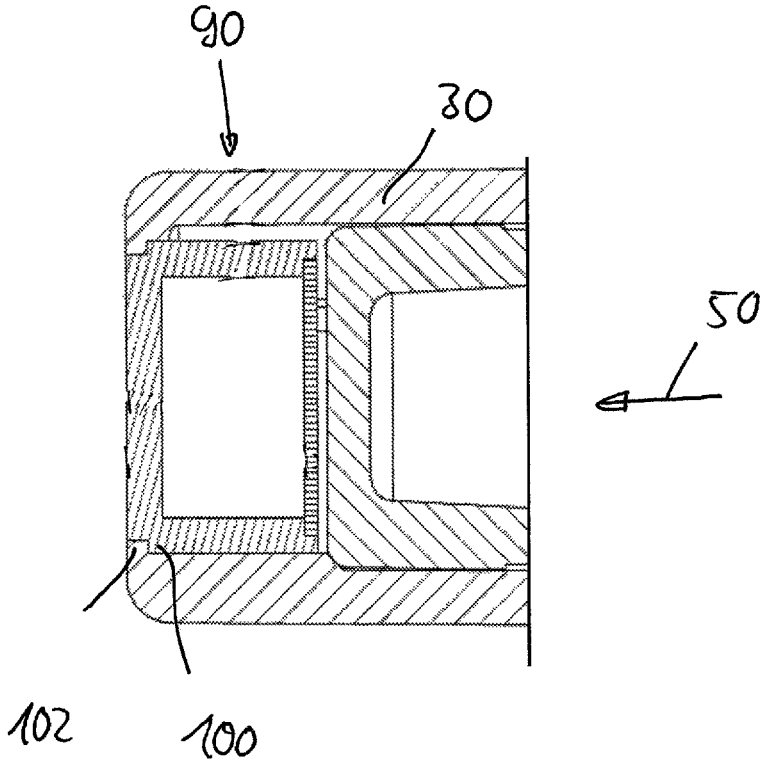
FIG. 14 shows a cartridge inserted from the inside.

FIG. 14 shows a cartridge 90 in an alternative configuration to FIG. 13, the only difference being that the protrusion 100 and stop 102 are facing in the opposite direction, in which case, during assembly of the pen 2, the cartridge 90 is inserted into the outer cap 30 in the direction of the arrow 50.

The invention claimed is:

1. A pen, comprising:

a shank formed with a reservoir for storing an application fluid including a solvent being volatile at room temperature, the shank including an applicator tip for applying the application fluid; and a closure cap fitted onto the shank, the closure cap formed with a cavity for accommodating the applicator tip, the closure cap having an inside surface, the closure cap formed with a storage chamber for storing a sacrificial liquid being volatile at room temperature, and the closure cap formed with a connecting channel fluidly communicating with the storage chamber and the cavity, the cavity of the closure cap defining an opening;

the shank having a portion projecting into the cavity of the closure cap;

the closure cap including a sealing element being movable between a closing position in which the sealing element closes the connecting channel and an open position in which the sealing element frees the connecting channel, the sealing element being mounted in an axially displaceable manner in the closure cap;

the sealing element including a wall segment delimiting the storage chamber from the cavity in a manner leaving free at least one longitudinal portion of the connecting channel, the inside surface of the closure cap and the wall segment defining a gap therebetween forming at least one longitudinal portion of the connecting channel;

the sealing element including a driver element interacting with the shank portion and being directed toward the opening of the closure cap;

a closure element closing the gap in the closing position of the sealing element, the closure element being formed on the inside surface of the closure cap; and wherein in order to move in a direction of the open position and/or in a direction of the closing position, the sealing element is movably coupled to the portion of the shank that projects into the cavity of the closure cap.

2. The pen according to claim 1, wherein the gap has a smaller flow cross section than other portions of the connecting channel.

3. The pen according to claim 1, wherein the gap is an annular gap.

4. The pen according to claim 1, wherein the closure element is an encircling annular protrusion.

5. The pen according to claim 1, further comprising:

an inner cap located within the closure cap;

the sealing element being a part of the inner cap.

6. The pen according to claim 5, wherein:

the cavity of the closure cap defines an opening;

the sealing element includes a wall segment that delimits the storage chamber from the cavity in a manner leaving free at least one longitudinal portion of the connecting channel;

the sealing element includes a driver element that interacts with the shank portion and that is directed toward the opening of the closure cap;

the wall segment forms a base of the inner cap; and the driver element forms a wall of the inner cap.

7. The pen according to claim 1, further comprising:

an axially effective first form fit and a second form fit;

the sealing element being mounted in an axially displaceable manner in the closure cap;

the axially effective first form fit limiting a relative movement between the sealing element and the closure cap during removal of the closure cap;

the second form fit enabling movement coupling between the sealing element and the shank portion during removal of the closure cap;

the first form fit having a greater level of strength in an axial direction than the second form fit for allowing the sealing element to be held in the closure cap during removal of the closure cap.

8. The pen according to claim 7, wherein:

the first form fit is formed by radially overlapping protrusions on the closure cap on the and sealing element; and the second form fit is formed by radially overlapping protrusions on the sealing element and on the shank portion.

9. The pen according to claim 7, wherein:

the closure cap includes a stop, the sealing element includes a protrusion, and the first form fit is formed by the stop of the closure cap and the protrusion of the sealing element; and the shank portion includes a latching nose, the sealing element includes a latching protrusion, and the second form fit is formed by the latching nose on the shank portion and the latching protrusion on the sealing element.

10. The pen according to claim 1, further comprising:

a covering element being movably coupled to the sealing element;

the cavity of the closure cap defining an opening; and when the closure cap is in a released state, the covering element concealing a portion of the closure cap that adjoins the opening.

11. The pen according to claim 10, further comprising an inner cap located within the closure cap, wherein:

the sealing element is a part of the inner cap;

the inner cap has an end portion that is directed toward the opening; and the end portion, which is directed toward the opening, forms the covering element.

12. The pen according to claim 1, further comprising:

a storage element for storing the sacrificial liquid;

the storage element located in the storage chamber.

13. The pen according to claim 12, wherein the storage element is a cartridge.

14. The pen according to claim 13, wherein:

the closure cap is formed with a through-passage; and the cartridge is inserted in the through-passage.

15. The pen according to claim 13, further comprising:

an inner cap located within the closure cap;

the sealing element being a part of the inner cap; and at least part of the cartridge being integral with the inner cap.

16. The pen according to claim 1, wherein at least part of the connecting channel is formed as a capillary channel.

* * * * *